US006082166A

United States Patent [19]

Marin

[11] Patent Number: 6,082,166

[45] Date of Patent: Jul. 4, 2000

[54] DRAWING AND COINING DIE FOR MANUFACTURING METAL CONTAINERS AND THE LIKE

[75] Inventor: Visino Marin, Casalbellotto, Italy

[73] Assignee: Attrezzeria M.V. di Marin Visino e C. S.n.c., Casalmaggiore, Italy

[21] Appl. No.: 09/199,197

[22] Filed: Nov. 25, 1998

[30] Foreign Application Priority Data

Nov. 28, 1997 [IT] Italy ..... MN97A0041

[51] Int. Cl.[7] ..... B21D 22/00; B21D 22/21

[52] U.S. Cl. ..... 72/348; 72/361

[58] Field of Search ..... 72/347, 348, 349, 72/358, 359, 350, 351, 361

[56] References Cited

U.S. PATENT DOCUMENTS 3,654,795 4/1972 Freber .
3,955,394 5/1976 Kaufman et al. .
4,361,020 11/1982 Hirota et al. ..... 72/348

FOREIGN PATENT DOCUMENTS 609 907 3/1946 United Kingdom .

OTHER PUBLICATIONS

Patent Abstracts of Japan vol. 007, No. 250 (M–254), Nov. 8, 1983—& JP 58 1357 32 A (Shinsei Kinzoku Kogyo KK), Aug. 12, 1983 * abstract * .

Patent Abstracts of Japan vol. 009, No. 038 (M–358), Feb. 19, 1985 & JP 59 179246 A (Nihon Keikinzoku KK), Oct. 11, 1984 * abstract *.

Patent Abstracts of Japan vol. 096, No. 011, Nov. 29, 1996—& JP 08 16 88 30 A (Nippondenso Co Ltd), Jul. 2, 1996 * abstract*.

*Primary Examiner*—Rodney A. Butler
*Attorney, Agent, or Firm*—Guido Modiano; Albert Josif; Daniel O"Byrne

[57] ABSTRACT

A drawing and coining die for manufacturing metal containers and the like, comprising: a matrix, which is connected to a lower base adapted to be associated with a footing of a press and is provided with a device for centering a disk that constitutes the material to be processed; and a male element, which is connected to an upper base adapted to be associated with a movable slider of the press and is shaped so as to make contact with an edge of the resulting container.

9 Claims, 7 Drawing Sheets

DRAWING AND COINING DIE FOR MANUFACTURING METAL CONTAINERS AND THE LIKE

BACKGROUND OF THE INVENTION

The invention relates to a drawing and coining die for manufacturing metal containers and the like.

It is known that metal containers, such as a for example pans in their many constructive shapes, and similar items, are manufactured by means of dies which are associated with a press. The finished product is obtained starting from a metal disk which is first drawn by the action of a male element combined with a matrix, assuming the intended shape without substantial variations in thickness, with a final coining to obtain a shape which has a modulated thickness.

Conventional dies suffer some drawbacks, one of which is the fact that products obtained with such dies entail the presence of burr which forces to perform one or more finishing passes, considerably increasing the manufacturing costs.

SUMMARY OF THE INVENTION

The aim of the present invention is to provide a die which has improved characteristics with respect to conventional dies and in particular allows to manufacture metal containers and the like without burr thereon.

This aim is achieved by a drawing and coining die for manufacturing metal containers and the like, according to the invention, characterized in that: a matrix, which is connected to a lower base adapted to be associated with a footing of a press and is provided with means for centering a disk that constitutes the material to be processed; a male element, which is connected to an upper base adapted to be associated with a movable slider of the press and is shaped so as to make contact with an edge of the resulting container.

Advantageously, a blank holder is provided which is connected to the upper base by means which allow changes in their mutual distance and with elastic elements interposed which are adapted to make contact with the matrix.

BRIEF DESCRIPTION OF THE DRAWINGS

Further characteristics and advantages of the present invention will become apparent from the following detailed description of some preferred but not exclusive embodiments thereof, illustrated by way of nonlimitative example in the accompanying drawings, wherein.

DESCRIPTION OF THE PREFERRED EMBODIMENT

With reference to the above FIGS. 1 to 7, 1 designates a matrix, which is connected, by means of screws 2 and with a spacer 3 interposed, to a lower base 4, which is adapted to be associated with a footing of a press (not shown).

Figure 1:
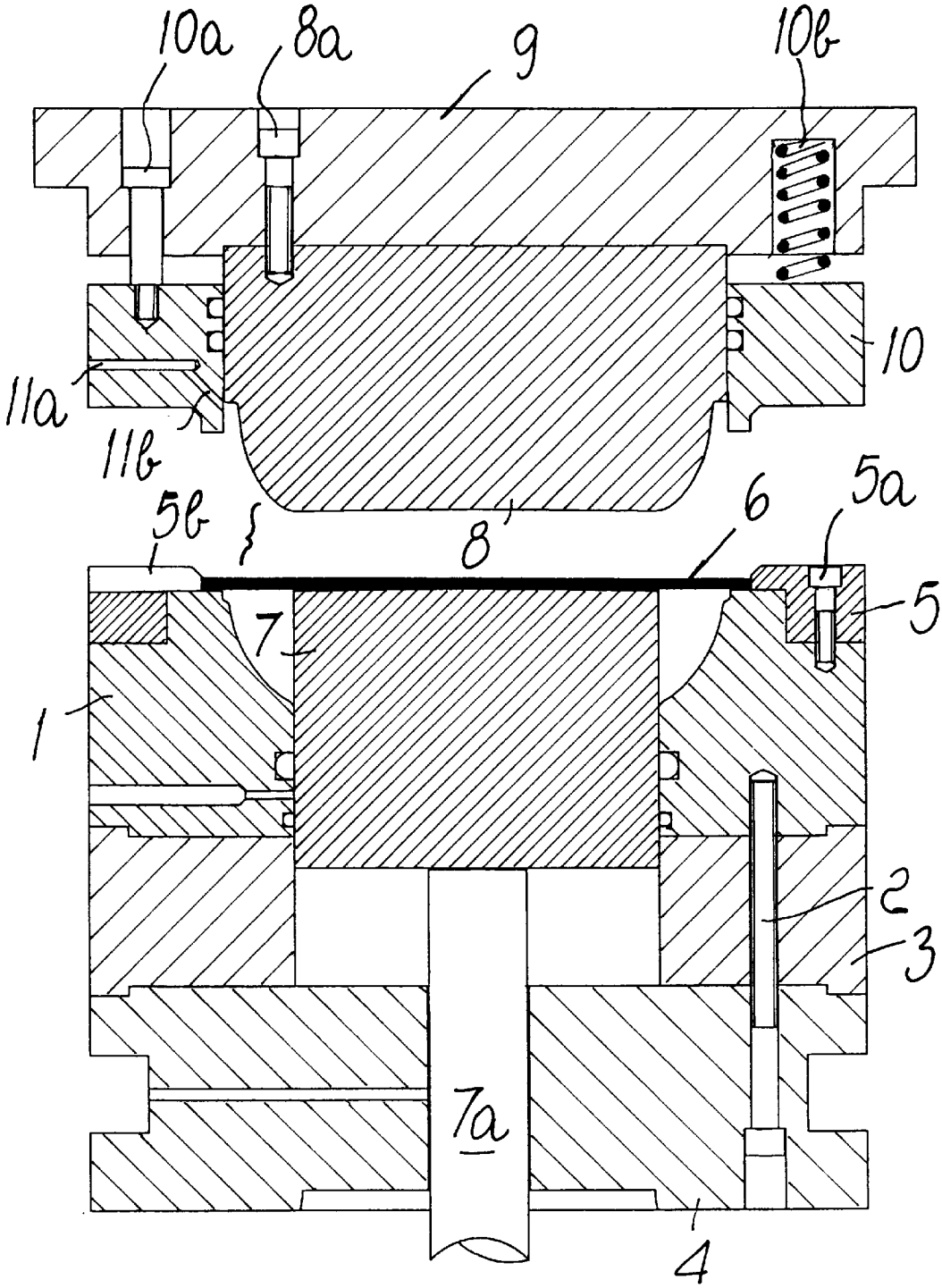
FIG. 1 is a sectional view of the die in the open condition.
Figure 2:
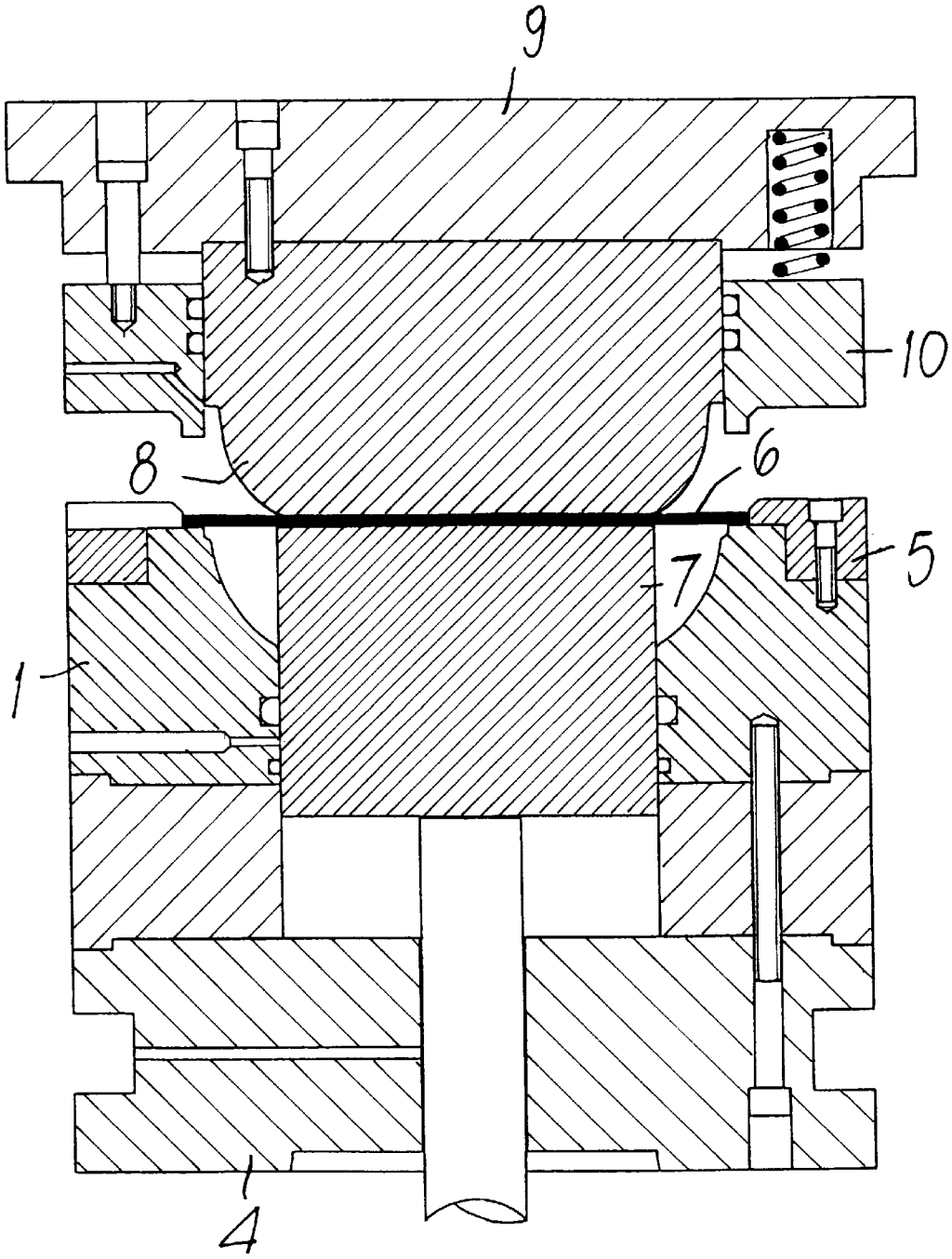
FIGS. 2 and 3 are sectional views of successive steps of the closure of the die.
Figure 3:
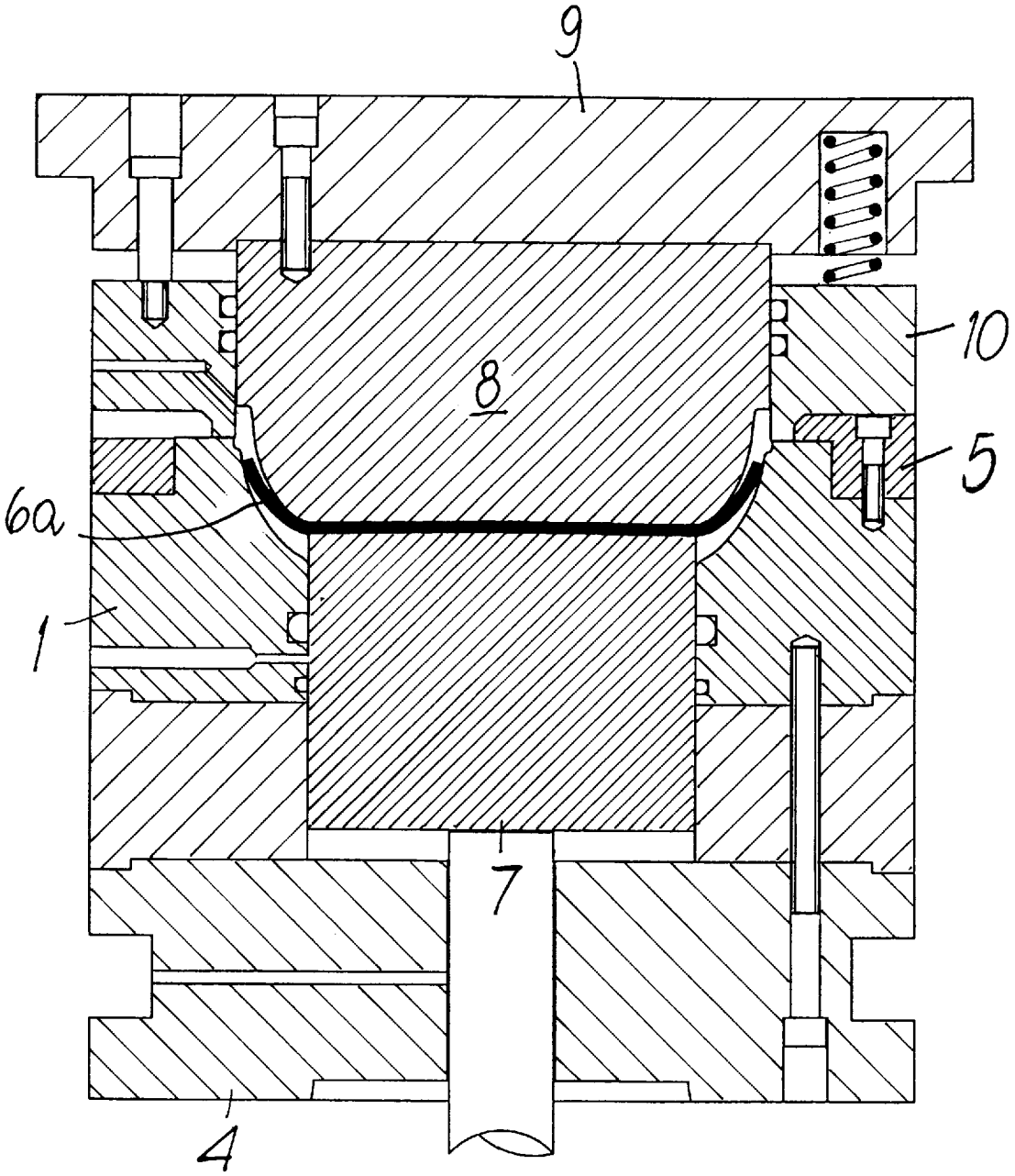

The matrix is provided with a ring 5, which is detachably fixed by means of screws 5*a*, for centering a disk 6 to be processed, shown in FIGS. 1 and 2, while FIG. 3 illustrates a step 6*a* of the modification of said disk for approaching a final configuration 6*b* shown in FIGS. 4, 5, 6 and 7.

The disk 5 comprises a region, designated by the reference numeral 5*b*, which allows the passage of the finished product.

In the matrix 1, at the bottom thereof, a plate 7 is provided, which is equipped with movement means comprising a shaft 7*a* which protrudes from the footing of the press and is managed by a fluid-actuated system with which the press is provided.

The reference numeral 8 designates a male element which is connected, by means of screws 8*a*, to an upper base 9, adapted to be associated with the movable slider of the press. A blank holder 10 is also connected to the base 9 through sliding traction elements 10*a* and with the interposition of springs 10*b*.

Figure 7:
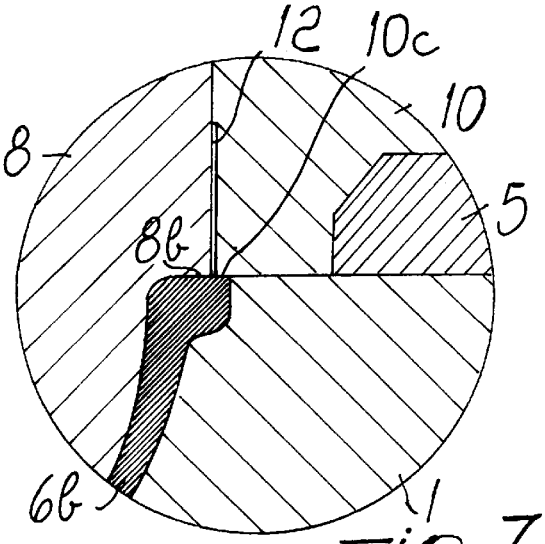

The blank holder 10 includes a duct formed by two portions 11*a*, 11*b* for feeding air under pressure into an interspace 12, which is shown in FIG. 7 and is formed between the male element 8 and the blank holder 10, as explained hereinafter.

An important feature of the invention which also will be explained hereinafter and is clearly shown in FIG. 7 is the fact that the male element 8 is shaped so as to make contact at the region 8*b* with an upper edge of the resulting product 6*b*, with the only exception of a band which is located in the outer peripheral region and whereon the blank holder 10 acts. Said blank holder rests on the matrix 1 and has a band 10*c* which protrudes onto the impression formed in the matrix so as to form a shape which is complementary to the shape of the container to be obtained.

Figure 6:
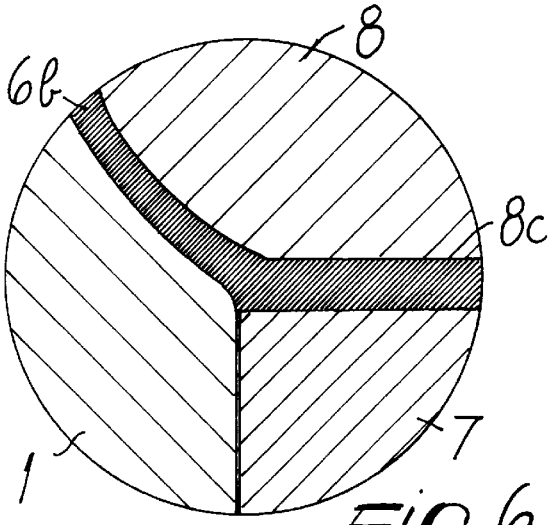
FIGS. 6 and 7 are enlarged-scale sectional views of details of the circled regions of FIG. 4.

Another important characteristic of the invention which will also be described hereinafter and is shown in FIG. 6 is the fact that the plate 7 is slightly larger than the end cross-section 8*c* of the male element 8.

The operation of the invention is now described starting from the condition in which the die is open, as shown in FIG. 1.

The upper base 9 descends and the male element 8, starting from the position of first contact with the disk 6 shown in FIG. 2, draws said disk, which is supported so as to allow yielding by the plate 7, which reacts with a force which is adjusted by the fluid-actuated system for managing the shaft 7*a*. FIG. 3 illustrates the intermediate step of the drawing, during which the blank holder 10 has made contact with the matrix 1.

Figure 4:
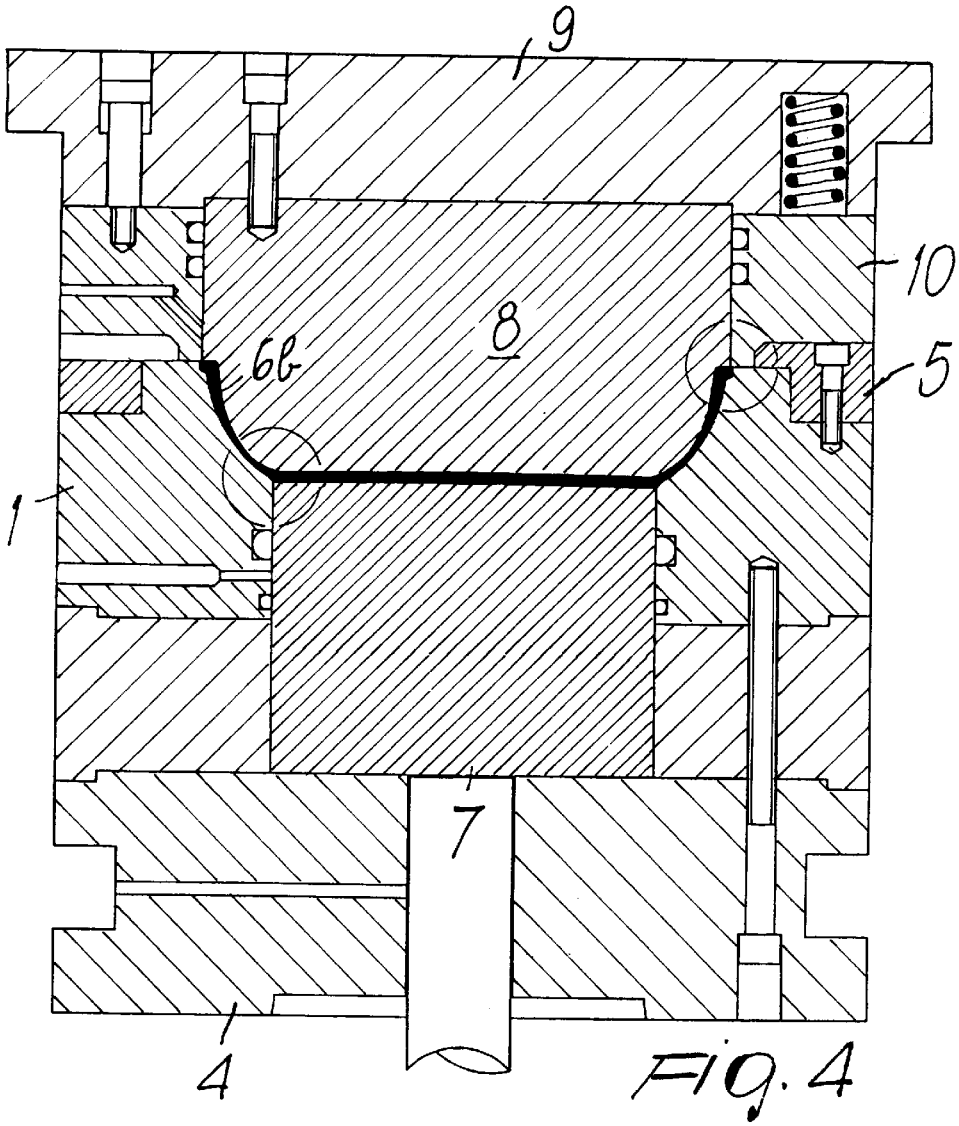
FIG. 4 is a sectional view of the closed die with the finished product.

The further descent of the upper base 9 from the position of FIG. 3 occurs thanks to the sliding of the traction elements 10*a* in the base 9 and with a compression of the springs 10*b*, and ends the drawing operation, which is followed, during the last moments of the descent of the male element 8, by coining with compression of the product so as to produce a migration of material within the impression so as to give to the product the configuration 6*b* which has a modulated thickness, shown in FIGS. 4 to 7. FIG. 4 illustrates the condition in which the die is closed and the product is perfectly formed.

The important characteristics of the invention shown by FIGS. 6 and 7 perform their function during the coining step, because the material that migrates inside the impression between the male element 8 and the matrix 1 reaches the regions where there is the clearance, in said impression, between the matrix 1 and the disk 7, as shown in FIG. 6, and there is the gap 12 shown in FIG. 7, when the migration is ending, and therefore the transfer of material into said spaces which would cause burr does not occur.

The product that leaves the die according to the invention therefore requires no finishing pass.

The blank holder 10 which, in the described embodiment, actually has not performed the function implied by its name, but rather has completed, with the region 10*c*, the matrix 1 in forming the impression meant to be filled by the material being processed, is also highly important during the first steps of the opening of the die to remove the finished product from the male element 8.

When the upper base 9 rises, pulling the male element 8 with it, the blank holder 10 remains, thanks to the action of springs 10*b*, in the position reached earlier, so as to lock the finished product 6*b* in the matrix 1 thanks to its contact in the region 10*c*.

The danger is thus avoided of the finished product remaining attached to the male element 8, which would interrupt the automatic continuous operation of the die. An additional safety against the occurrence of this circumstance is constituted by the pressurized air jet that is sent through the ducts 11*a*, 11*b* into the interspace 12 during the first moments of the ascent of the male element 8.

Figure 5:
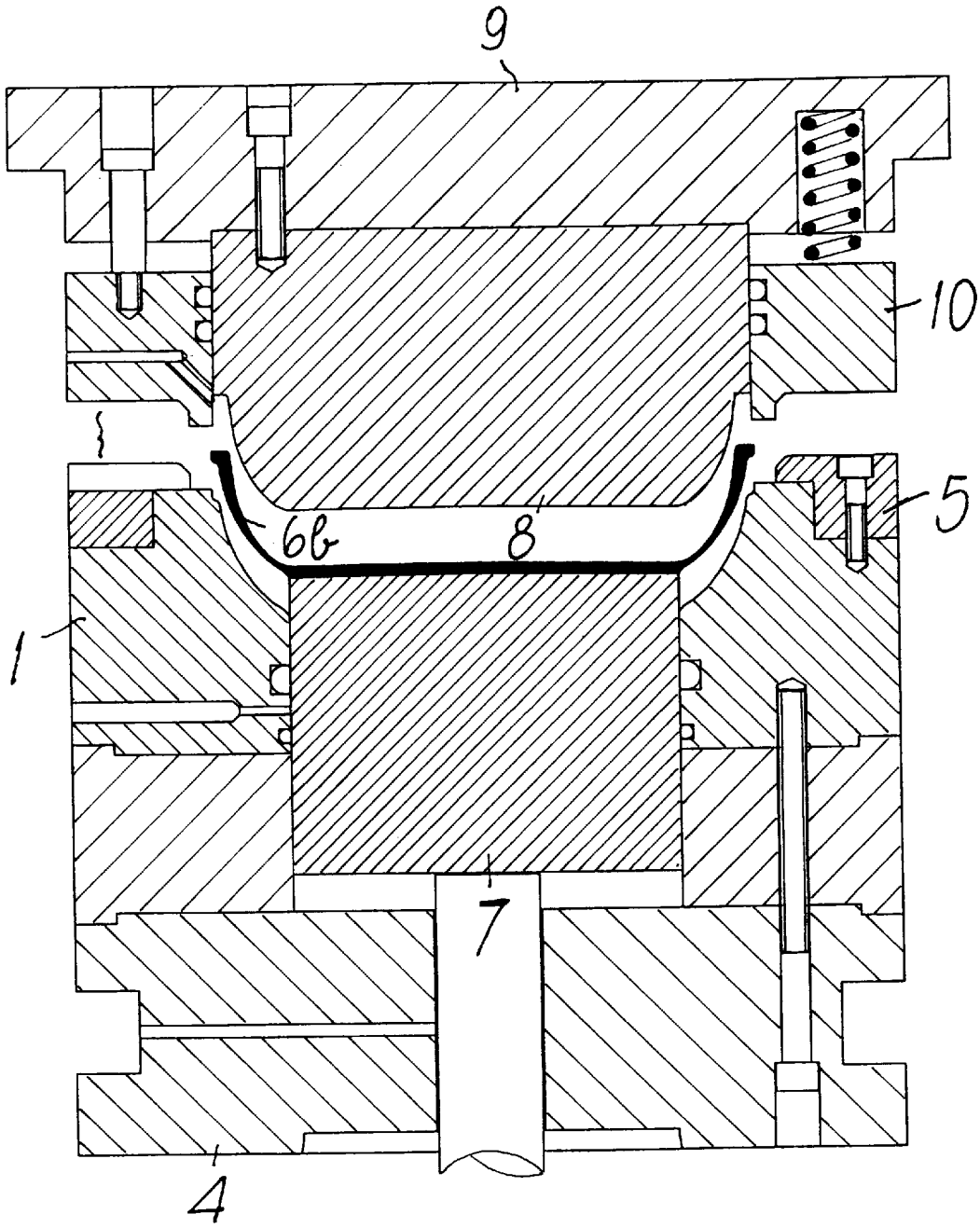
FIG. 5 is a sectional view of the die in an opening step.

The base 9 therefore rises and subsequent steps of the opening of the die occur, such as the one shown in FIG. 5, which shows that the finished product 6*b* is guided out of the matrix 1 by the action of the plate 7, which is conveniently moved by the shaft 7*a* according to the adjustment of the fluid-actuated system for managing said shaft, until it can be received by an extraction arm through the region 5*b* of the centering disk 5.

Figure 8:
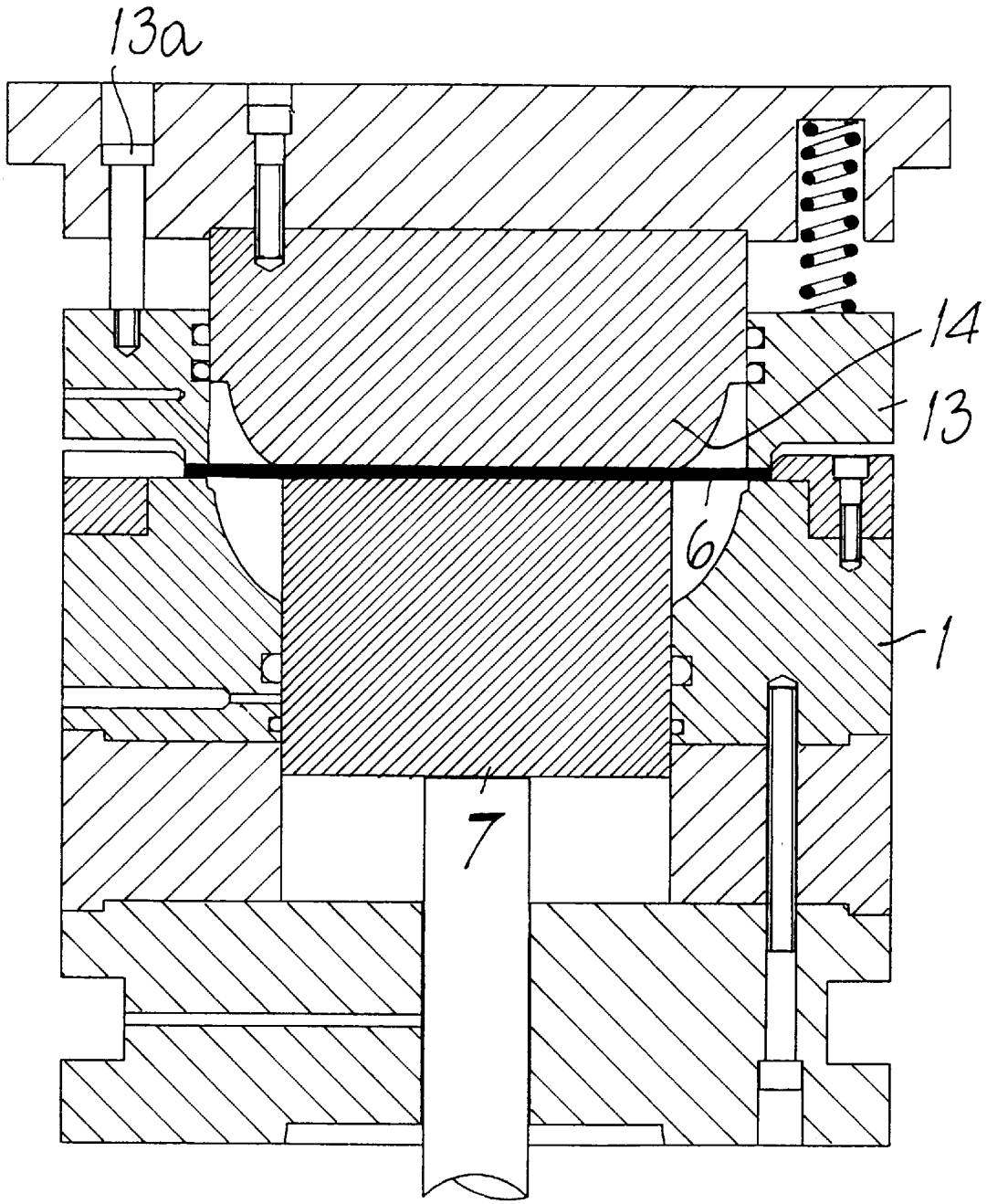
FIG. 8 is a sectional view of a first embodiment of the invention, during the closure thereof.

The blank holder 13 performs the function implied by its name in the embodiment shown in FIG. 8, in which the traction elements 13*a* are longer than the traction elements 10*a* of the first described embodiment and also determine, at the very first contact between the male element 14 and the disk 6 to be processed, the contact of the blank holder 13 with the disk 6.

The typical function of the blank holder 13 is therefore provided during the first drawing steps; thereafter, at a certain moment said blank holder releases the disk being processed and makes contact with the matrix 1.

In this embodiment, the male element 14 is shaped so as to make contact with the edge of the resulting container as a whole, and therefore the blank holder 13 no longer has any band that is located at the inner peripheral region and protrudes onto the recess formed in the matrix 1 so as to form a shape which is complementary to the shape of the container, renouncing the functions of matrix completion and of extractor for removing the finished part from the male element 8 presented in the previously described embodiment.

With the male element 8 shaped as shown in the embodiment of FIG. 8, the blank holder might also be omitted.

Figure 9:
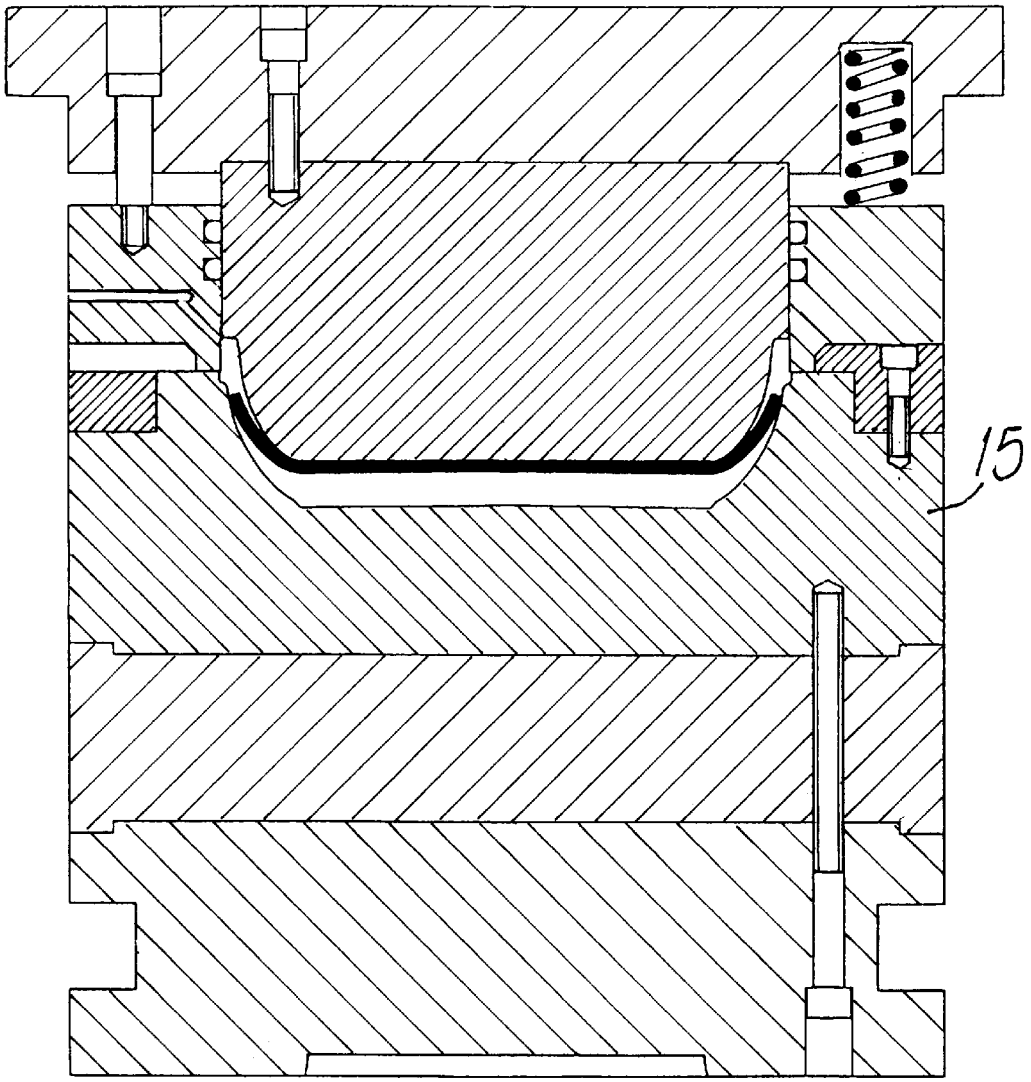
FIG. 9 is a sectional view of a second embodiment of the invention, during the closure thereof.

A further embodiment is described in FIG. 9, in which a matrix 15 is provided, which does not have a plate that follows the finished product as it leaves the die and therefore this function is assigned to different means, such as for example suckers; as regards the rest, the die has the previously described characteristics.

The present invention is susceptible of numerous other modifications and variations, all of which are within the scope of the inventive concept: thus, for example, the plate 7 might be moved by means of underlying elastic means.

In the practical embodiment of the invention, all the details may be replaced with other technically equivalent elements; the materials employed, as well as the shapes and the dimensions, may be any according to requirements.

The disclosures in Italian Patent Application No. MN97A000041 from which this application claims priority are incorporated herein by reference.

What is claimed is:

1. A drawing and coining die for manufacturing metal containers, comprising:

a matrix, which is connected to a lower base for being connected with a footing of a press and which is provided with means for centering a disk that constitutes the material to be processed;

a male element, which is connected to an upper base for being connected with a movable slider of the press and which comprises a peripheral contact region shaped so as to make contact with an edge of the resultant container interposed between said matrix and said male element in a fully closed configuration of said die; and a blank holder which extends about said male element and which is connected to said upper base through means which allow the distance between said blank holder and said upper base to vary and with elastic elements interposed between said blank holder and said upper base, said blank holder and said male element and said matrix being mutually configured such that in said fully closed configuration of said die a bottom surface of said blank holder makes contact with the matrix and said bottom surface of said blank holder extends in a same plane as said peripheral contact region of said male element.

2. The die according to claim 1, wherein said bottom surface of said blank holder comprises a band which makes contact with the edge of the resulting container in said fully closed configuration of said die.

3. The die according to claim 1, wherein the male element is shaped so as to make contact with the edge of the resulting container as a whole.

4. The die according to claim 1, wherein the blank holder is connected to the upper base by virtue of sliding traction elements and with springs interposed.

5. The die according to claim 1, wherein, within the blank holder, a duct is provided for feeding compressed air into an interspace defined between said blank holder and the male element in said fully closed configuration of said die.

6. The die according to claim 1, wherein a plate provided with movement means is arranged within the matrix at a bottom of said matrix, said plate being slightly larger than the dimensions of an end cross-section of the male element.

7. The die according to claim 6, wherein the movement means for moving the plate comprise an underlying shaft which protrudes from the footing of the press and is controlled by a fluid-driven system with which said press is equipped.

8. The die according to claim 6, wherein said movement means comprise underlying elastic means.

9. A drawing and coining die for manufacturing metal containers, comprising:

a matrix, which is connected to a lower base for being connected with a footing of a press and which is provided with means for centering a disk that constitutes the material to be processed;

a male element, which is connected to an upper base for being connected with a movable slider of the press and which comprises a peripheral contact region shaped so as to make contact with an edge of the resulting container interposed between said matrix and said male element in a fully closed configuration of said die; and a disk centering ring which is detachably fixed to said matrix and which comprises a region which allows the passage of the resulting container.

* * * * *